US005546161A

United States Patent [19]

Sakai et al.

[11] Patent Number: 5,546,161

[45] Date of Patent: Aug. 13, 1996

[54] IMAGE FORMING SYSTEM HAVING MAIN POWER SOURCE

[75] Inventors: Akihiro Sakai, Kawasaki; Yoshio Mizuno, Ichikawa; Takehito Utsunomiya, Yokohama, all of Japan

[73] Assignee: Canon Kabushiki Kaisha, Tokyo, Japan

[21] Appl. No.: 145,319

[22] Filed: Nov. 3, 1993

Related U.S. Application Data

[63] Continuation of Ser. No. 868,638, Apr. 15, 1992, abandoned.

[30] Foreign Application Priority Data

| | | | |
|---|---|---|---|
| Apr. 17, 1991 | [JP] | Japan | 3-112578 |
| May 15, 1991 | [JP] | Japan | 3-110456 |
| Jun. 26, 1991 | [JP] | Japan | 3-154578 |
| Mar. 31, 1992 | [JP] | Japan | 4-077444 |

[51] Int. Cl.[6] ..... G03G 15/20

[52] U.S. Cl. ..... 355/200; 355/285

[58] Field of Search ..... 355/200, 205, 355/206, 207, 285, 313, 282, 289, 290; 219/216

[56] References Cited

U.S. PATENT DOCUMENTS

| | | | |
|---|---|---|---|
| 3,737,734 | 6/1973 | Nakamura et al. | 355/200 X |
| 4,480,195 | 10/1984 | Sawaki et al. | 355/208 X |
| 4,504,139 | 3/1985 | Nozaki et al. | 355/200 |
| 4,618,245 | 10/1986 | Fukushi et al. | 355/282 |
| 4,745,436 | 5/1988 | Matsuura | 355/206 |
| 4,771,312 | 9/1988 | Yanase et al. | 355/200 |
| 4,870,526 | 9/1989 | Marata et al. | 355/206 X |
| 4,873,553 | 10/1989 | Inaba | 355/295 |
| 4,874,958 | 10/1989 | Sampath et al. | 355/309 |
| 5,043,763 | 8/1991 | Koh et al. | 355/206 |
| 5,061,957 | 10/1991 | Nishikawa et al. | 355/200 |

FOREIGN PATENT DOCUMENTS

| | | |
|---|---|---|
| 0374738 | 6/1990 | European Pat. Off. . |
| 0390168 | 10/1990 | European Pat. Off. . |
| 0155134 | 12/1981 | Japan . |
| 0158661 | 9/1983 | Japan . |
| 0174969 | 10/1983 | Japan . |
| 0227635 | 12/1984 | Japan . |
| 0149473 | 7/1987 | Japan . |
| 0099980 | 5/1988 | Japan . |
| 0321444 | 12/1989 | Japan . |
| 0307777 | 12/1990 | Japan . |
| 0045971 | 2/1991 | Japan . |
| 0144662 | 6/1991 | Japan . |

*Primary Examiner*—Robert Beatty

*Attorney, Agent, or Firm*—Fitzpatrick, Cella, Harper & Scinto

[57] ABSTRACT

An image forming apparatus includes a recording sheet supplying portion for supplying a recording sheet and an image forming device for forming an image on the recording sheet supplied from the recording sheet supplying portion. A main power source supplies electric power to the image forming device and thermal fixing device. A recording sheet detector detects whether the recording sheet is present on the recording sheet supplying portion and a sub-power source supplies electric power to the recording sheet detector. A main power source switch automatically activates the main power source when the recording sheet detector detects the presence of the recording sheet or an image formation signal is inputted. The image forming apparatus does not include a main power switch to manually control the main power source.

15 Claims, 11 Drawing Sheets

IMAGE FORMING SYSTEM HAVING MAIN POWER SOURCE

This application is a continuation of application Ser. No. 07/868,638, filed Apr. 15, 1992, now abandoned.

BACKGROUND OF THE INVENTION

1. Field of the Invention

The present invention relates to an image forming system such as a copying machine, printer and the like, and more particularly, it relates to an image forming system having a fixing means for fixing an image on a recording sheet.

2. Related Background Art

In the past, in image forming systems such as copying machines, printers and the like, it is necessary to turn ON a main power source by activating a main switch before the system is operated. In this case, an operator suffers from the trouble that he must search the main switch and turn it on, and a problem arises that when the operator forgot to turn the main switch off the electric power is consumed in vain.

To avoid this, in some conventional copying machines, a so-called auto shut-off mechanism was provided for automatically turning the power source off when the machine in the inoperative condition for a long time. However, even in such machines, the above-mentioned trouble could not be eliminated.

Further, when the electric power is turned ON by turning a print switch on, since a time required to enable an operation of a fixing means becomes long, it takes a long time to obtain a first copy.

In addition, recently, copying machines including a heat fixing device having no waiting time have been put into practical use; however, also in these machines, an operation for turning OFF the main switch is required.

SUMMARY OF THE INVENTION

An object of the present invention is to provide an image forming system wherein a main switch is not required to be turned OFF.

Another object of the present invention is to provide an image forming system wherein a main power source can be turned ON by detecting a recording sheet.

A further object of the present invention is to provide an image forming system comprising fixing means including means for forming a non-fixed image on a recording sheet, a heating body having a resistive layer used in a stationary condition and capable of emitting heat upon energization, and a film slidingly contacted with the heating body, and adapted to heat the image on the recording sheet with the heat from the resistive layer without the interposition of any air layer; a main power source; and main power source activating means for turning ON the main power source in response to an image signal.

A still further object of the present invention is to provide an image forming system comprising image forming means for forming an image on a recording sheet, a main power source for receiving an external electric power and for supplying an electric power to said image forming means, switching means for opening and closing a supply path from the external electric power to the main power source, and a battery for activating said switching means.

The other objects of the present invention will be apparent from the following descriptions.

DETAILED DESCRIPTION OF THE PREFERRED EMBODIMENTS

The present invention will now be explained in connection with embodiments thereof with reference to the accompanying drawings.

Figure 1:
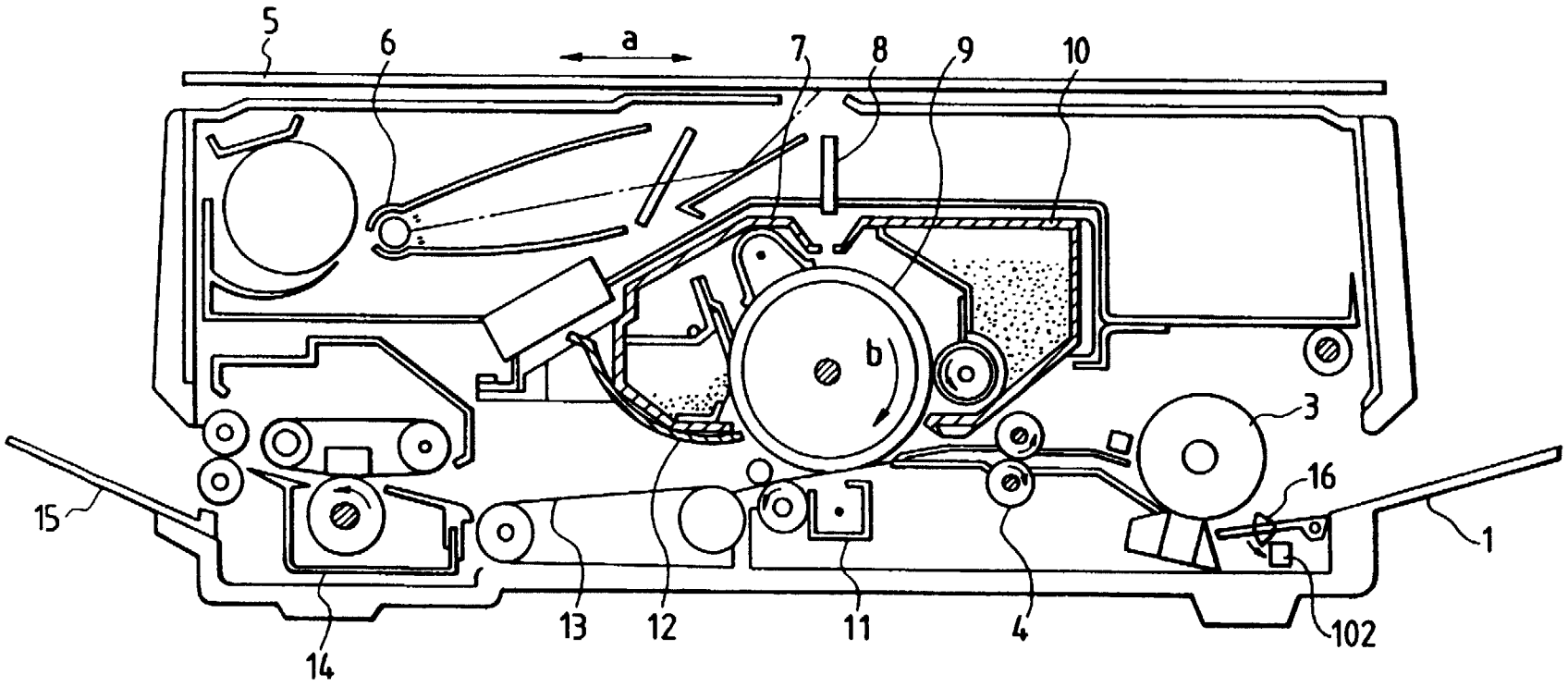
FIG. 1 is an elevational sectional view of an image forming system according to a preferred embodiment of the present invention.

FIG. 1 is an elevational sectional view of an electrophotographic copying machine as an image forming system according to a preferred embodiment of the present invention. In FIG. 1, the reference numeral 1 denotes a multi-manual sheet supply tray for successively and manually supplying a plurality of recording sheets.

When an operator sets a recording sheet on the manual sheet supply tray 1, the set recording sheet P pushes down a recording sheet detecting flag 16 disposed in a recording sheet feeding path, thus blocking an optical sensor of permeable type. This condition is detected by a recording sheet detector 102 which, in turn, outputs a detection signal to a control circuit 51. When the control circuit 51 receives the detection signal, it turns ON a main power source via a main power source ON/OFF circuit.

Figure 2:
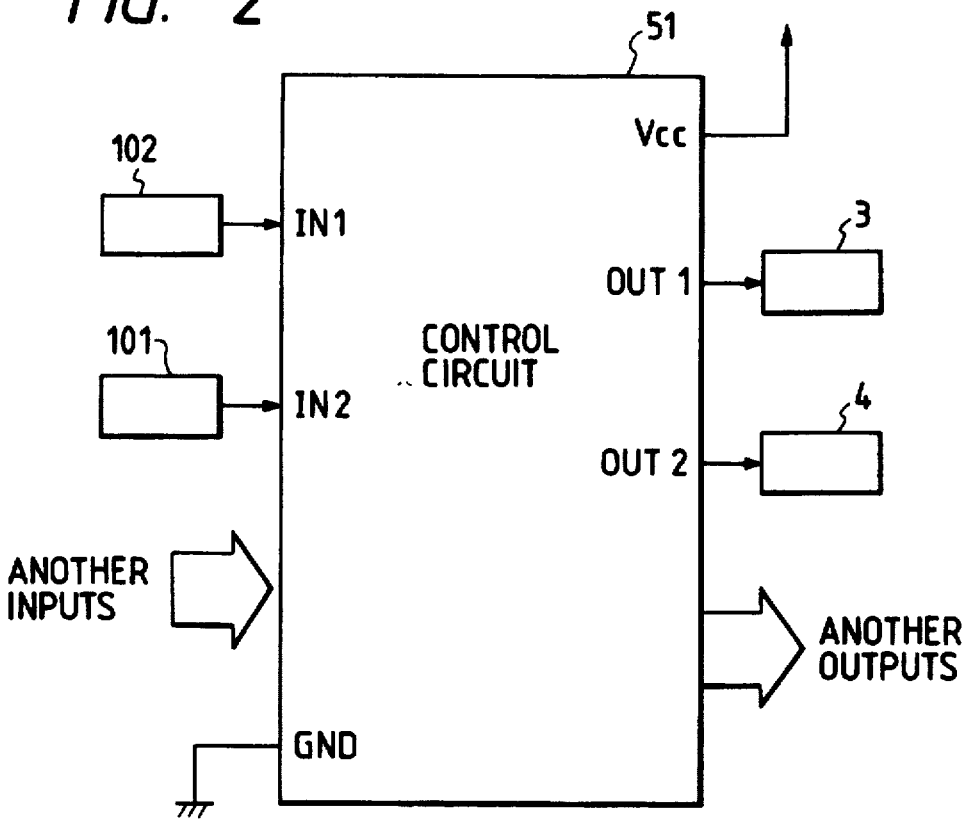
FIG. 2 is a block diagram of the system of FIG. 1.

When an image forming operation is started by depressing a copy switch 101 shown in FIG. 2 to input an image formation signal to the control circuit 51, the latter drives a sheet feed mechanism to start the image forming operation. That is to say, a pair of feed rollers 3 are rotated to feed the recording sheet P until the sheet is abutted against regist rollers 4.

On the other hand, an original support plate 5 comprising a transparent member such as a glass plate is driven by the sheet feed mechanism to reciprocally move in directions shown by the arrow a, thus scanning an original. Immediately below the original support plate 5, a short focus focusing element array 8 is disposed. An image on the original rested on the original support plate 5 is illuminated by light from a lighting lamp 6, and an light image reflected from the original is slit-exposed on a photosensitive drum 9 via the array 8. Incidentally, the photosensitive drum 9 is driven by the sheet feed mechanism to rotate in a direction shown by the arrow b.

The photosensitive drum 9 coated by, for example, a photosensitive zinc oxide layer or a photosensitive organic semi-conductor layer is uniformly charged by a charger 7. The photosensitive drum 9 uniformly charged by the charger 7 is exposed by the light from the element array 8, thus forming an electrostatic latent image on the photosensitive drum 9. The electrostatic latent image is visualized by a developing device 10 with toner comprising resin and the like which is softened and melted by heat.

Now, the recording sheet P is fed to the photosensitive drum 9 by the paired feed rollers 4 (which are rotated and urged against each other in an up-and-down direction) in registration with the image formed on the photosensitive drum 9 driven by the sheet feed mechanism and the recording sheet P inserted by the operator. A toner image formed on the photosensitive drum 9 is transferred onto the recording sheet P by a transfer charger 11. Thereafter, the recording sheet P is separated from the photosensitive drum 9 in a well-known manner, and then is fed to a fixing device 14 by a feed guide 13 driven by the sheet feed mechanism. After the toner image transferred to the recording sheet is permanently fixed to the sheet by the fixing device with heat, the recording sheet is ejected onto an ejection tray 15. On the other hand, after the transferring operation, the residual toner remaining on the photosensitive drum 9 is removed by a cleaner 12.

After either an elapsed period of time required to return the original support plate to an initial position or a time required to completely eject the recording sheet P has elapsed, the image forming operation for the recording sheet is complete.

FIG. 2 shows a microcomputer or control circuit 51 for controlling the image forming system.

The microcomputer 51 incorporates therein an MPC, memories and other circuit elements, and serves to drive rollers 3, 4 in the sheet feed mechanism for feeding the recording sheet on the basis of the inputs from the copy switch 101 and the recording sheet detector 102 and other inputs, to control various image forming units on the basis of other synchronous signals, to control the whole image forming operation, and to control a power source circuit as will be described later.

Figure 3:
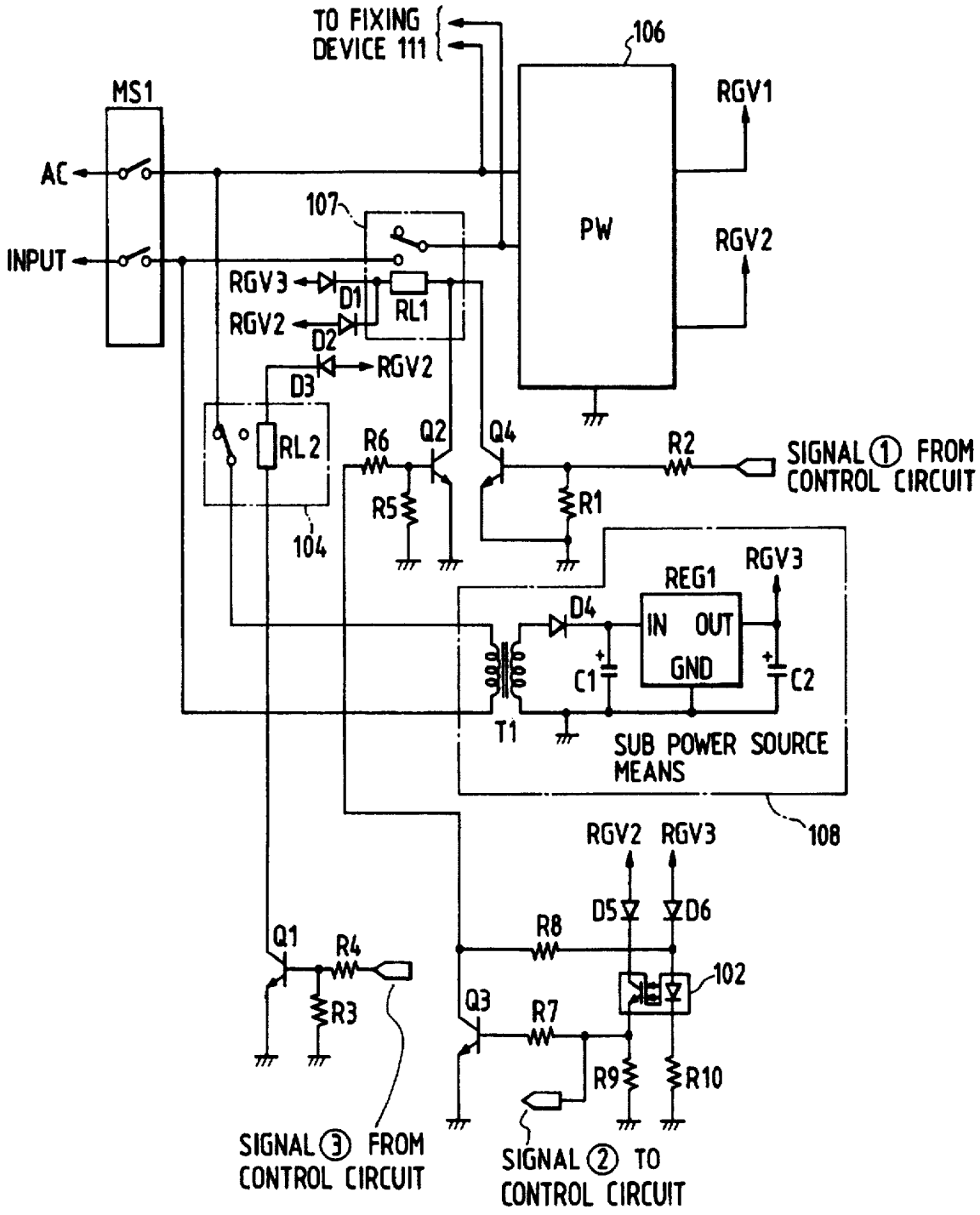
FIG. 3 is a circuit diagram showing a construction of a power source of the system of FIG. 1.

FIG. 3 is a circuit diagram showing a construction of a power source.

In a condition that an AC input is connected, when a main switch MS1 is energized, a sub power source means 108 drives the recording sheet detector 102 via a normally closed relay RL2 of a sub power source ON/OFF circuit 104. In this case, since a main power source (PW) 106 is blocked or shut-off by a normally open relay RL1 of a main power source ON/OFF circuit 107, the main power source is not activated at this time. Accordingly, even when the main switch MS1 is turned ON, in the image forming system, only the recording sheet detector 102 and the sub power source 108 become in the operative condition.

Then, in order to start the image forming operation, when the operator inserts the recording sheet P in the recording sheet supply portion, the recording sheet detector 120 detects the recording sheet. As a result, since an output ② of the recording sheet detector 102 becomes "L", a transistor Q3 is turned ON. Consequently, since a transistor Q2 is turned ON, the relay RL1 is driven, thus supplying the AC input to the main power source 106 and the fixing device 14.

Further, since voltages RGV1, RGV2 required to perform the image forming operation are supplied to the control circuit 51 for controlling the image forming system from the main power source 106, the control circuit 51 starts the building-up control. First of all, the control circuit 51 performs the initial setting, and then turns OFF the relay RL2 and holds the relay RL1 in the ON condition via transistors Q4, Q1 on the basis of signals ① and ③ of the control circuit 51 itself by the voltage (RGV2) from the main power source 106. Thereafter, the control circuit 51 controls the normal image forming operation. Incidentally, in this case, the control for turning OFF the sub power source 108 is effected by using the sub power source ON/OFF circuit 104 in order to save the energy. However, functionally, there is no problem even when the sub power source 108 is always energized.

Figure 4:
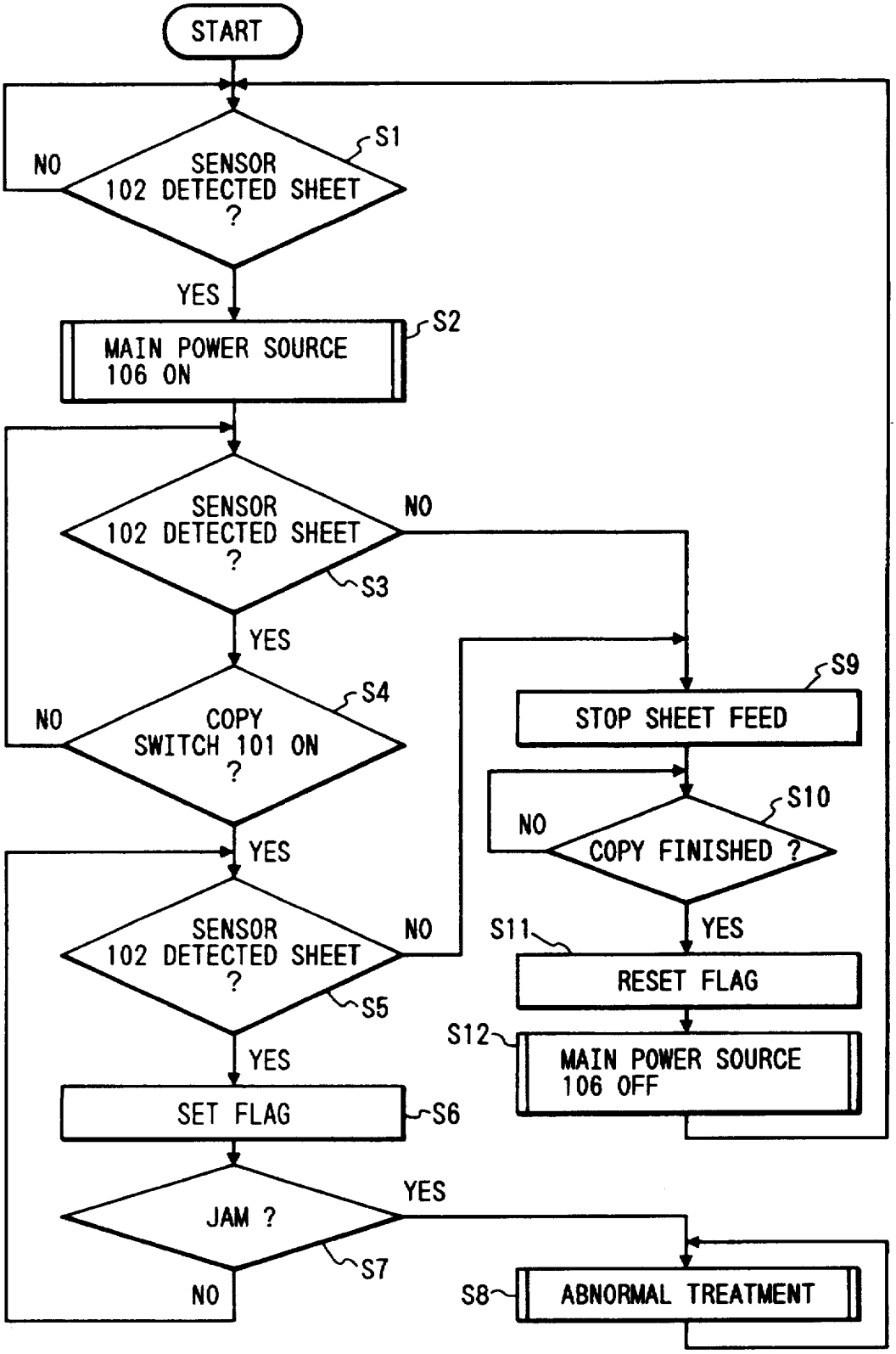
FIG. 4 is a flow chart showing an operating program for the system of FIG. 1.

FIG. 4 is a flow chart showing a control program for the system according to the illustrated embodiment. The program is stored in a ROM incorporated into the control circuit 51.

First of all, after initiation, only the recording sheet detector 102 is energized by the sub power source 108, thus monitoring whether the recording sheets are set on the recording sheet supply portion 1 or not by means of the recording sheet detector 102 (step S1). If the recording sheets are set on the recording sheet supply portion 1, the main power source 106 is turned ON by the main power source ON/OFF circuit 107 (step S2). Thereafter, monitoring whether the recording sheet is rested on the recording sheet supply portion 1 or not monitoring whether the copy switch 101 is depressed or not are effected (steps S3, S4); if there is no sheet, the program goes to a step S9, and, if the copy switch 101 is depressed, the program goes to a step S5.

In the step S5, it is judged again, by the recording sheet detector 102, whether the recording sheet is rested on the recording sheet supply portion; if there is no sheet, the program goes to the step S9, where the main power source 106 is turned OFF by the main power source ON/OFF circuit 107 and then the program returns to the step S1. To the contrary, if the recording sheet is rested on the recording sheet supply portion, the program goes to a step S6, where a flag is set and a copy process is started. Then, it is judged whether the jam condition is detected (step S7). If the jam condition is detected, the abnormal treatment is effected and the image forming operation is finished (step S8). Incidentally, when the jam occurs, by displaying the fact that the jam condition remains, without turning OFF the power source, it is possible to let the operator know the jam condition and to call upon the operator to perform the jam treatment.

To the contrary, if the jam condition is not detected, the program returns to the step S5. In the step S5, when the recording sheet becomes empty and the program goes to the step S9, the sheet feeding operation for the recording sheet is stopped, and it is judged whether any recording sheet is left within the image forming system or not (step S10); if the sheet does not remain, the image formation flag is reset (step S11), and then the main power source 106 is turned OFF by activating the main power source ON/OFF circuit 107 (step S12) so that only the recording sheet detector 102 is powered by the sub power source 108, and the program returns to the step S1.

Incidentally, in the illustrated first embodiment, while an example that the multi-feeder is used was explained, in place of the multi-feeder, a sheet supply cassette may be used to obtain the same technical effect.

Further, in the first embodiment, while an example that a phototransistor is used as the recording sheet detector was explained, in place of the phototransistor, the recording sheet may be detected by a mechanical means having a microswitch.

According to this embodiment, the main switch can be omitted, it becomes easier for the operator to handle the image forming system, and the power consumption during the stand-by condition can be minimized. Further, an input means for setting the number of copies and a copy number display can be omitted.

Next, a second embodiment of the present invention will be explained.

Incidentally, in this second embodiment, since the construction of the image forming system itself is the same as that of the first embodiment, the explanation thereof will be omitted.

Figure 5:
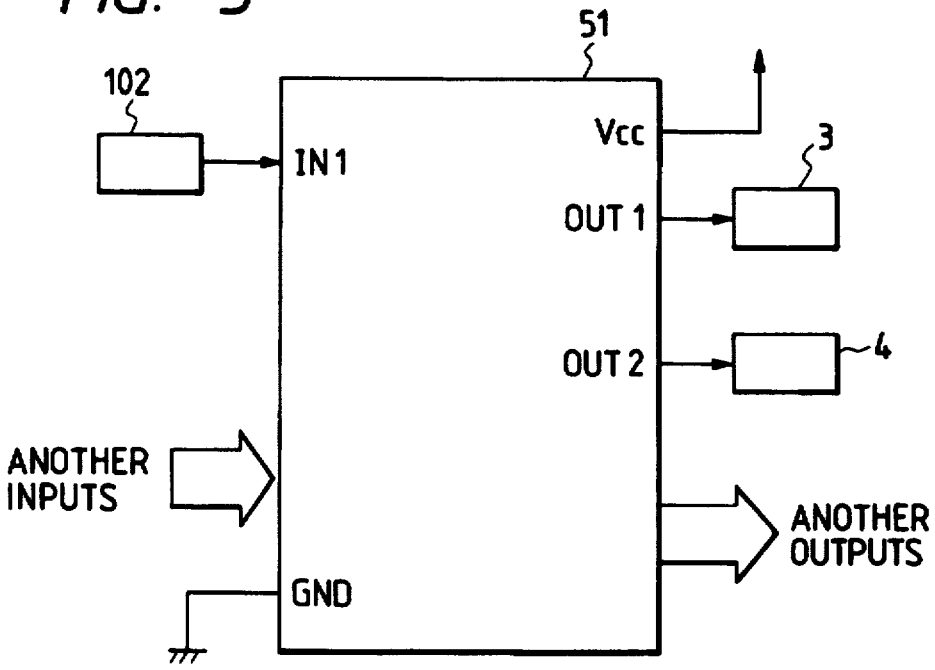
FIG. 5 is a block diagram of an image forming system according to a second embodiment of the present invention.
Figure 6:
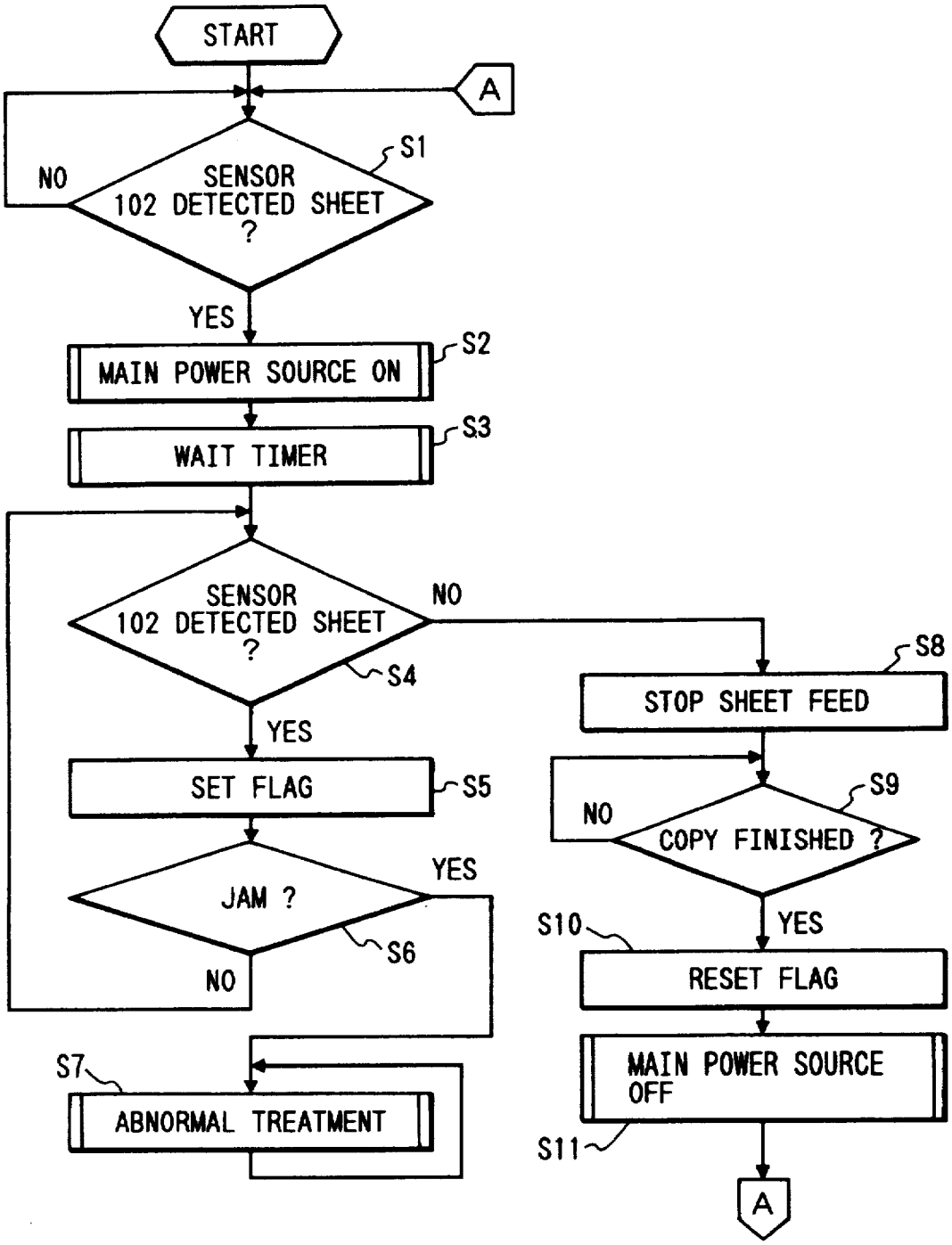
FIG. 6 is a flow chart showing an operating program for the system according to the second embodiment.

FIG. 5 shows a block diagram of a microcomputer 51 according to the second embodiment, and FIG. 6 is a flow chart showing the control program associated with the second embodiment. As apparent from FIGS. 5 and 6, in this embodiment, a copy switch is also omitted.

First of all, after initiation, in a step S1, only the recording sheet detector 102 is powered by the sub power source so that it is judged whether the recording sheets are set on the recording sheet supply portion or not by means of the recording sheet detector. If the recording sheets are set on the recording sheet supply portion, the program goes to a step S2, where the main power source is turned ON by the main power source ON/OFF circuit. Then, the program goes to a step S3. After a predetermined time period is elapsed in the step S3, it is again judged whether the recording sheets are rested on the recording sheet supply portion or not by means of the recording sheet detector (step S4); if there is no sheet, the program goes to a step S8 where the sheet feeding operation for the recording sheet is stopped, and then goes to a step S9. In the step S9, it is judged whether any recording sheet is left in the image forming system or not; if the sheet does not remain, the program goes to a step S10, where the image forming flag is reset. Then, the program goes to a step S11, where the main power source is turned OFF by activating the main power source ON/OFF circuit so that only the recording sheet detector is powered by the sub power source, and the program returns to the step S1.

In the step S4, if the recording sheet is set on the recording sheet supply portion, the program goes to a step S5, where the flag is set and the copy process is started. Then, the program goes to a step S6, where it is judged whether the jam condition occurs in the image forming system or not; if the jam condition is detected, the program goes to a step S7, where the abnormal treatment is effected and the image forming operation is finished. To the contrary, if the jam condition is not detected, the program returns to the step S4.

Next, a third embodiment of the present invention will be explained.

Figure 7:
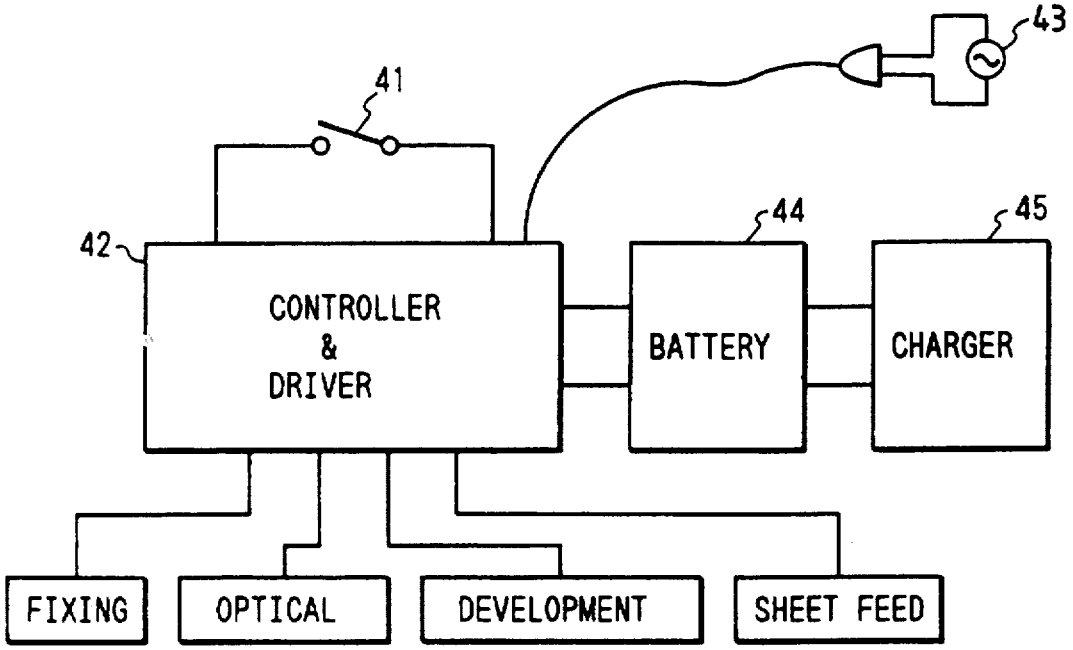
FIG. 7 is a block diagram of an image forming system according to a third embodiment of the present invention.

In FIG. 7 showing a block diagram according to the third embodiment, a signal from a copy start switch 41 is sent to a controller driver 42 which in turn sequentially controls loading portions (motors, solenoids and the like) of the sheet feeding means, developing means, optical means, fixing means and the like on the basis of such signal, thus performing the predetermined image forming operation, copying operation and the like.

Further, a battery 44 is a small power source for outputting the copy print signal from the copy start switch 41 and is normally charged by a charger 45 during the copying operation or printing operation.

A very low voltage is supplied from the battery 44 to the controller driver 42, and, in this point, the controller driver does not receive energy from an external AC power source 43. Now, when the copy start switch 41 is depressed (in a printer, it is not limited to the copy start switch 41, but may be print output signal), the controller driver 42 receives such signal. As a result, the controller driver can be supplied from the external AC power source 43 so that the copy print operation stand-by condition is attained. Thus, the image forming system immediately starts the copying operation, thereby initiating the copying operation with the minimum waiting time.

Figure 8:
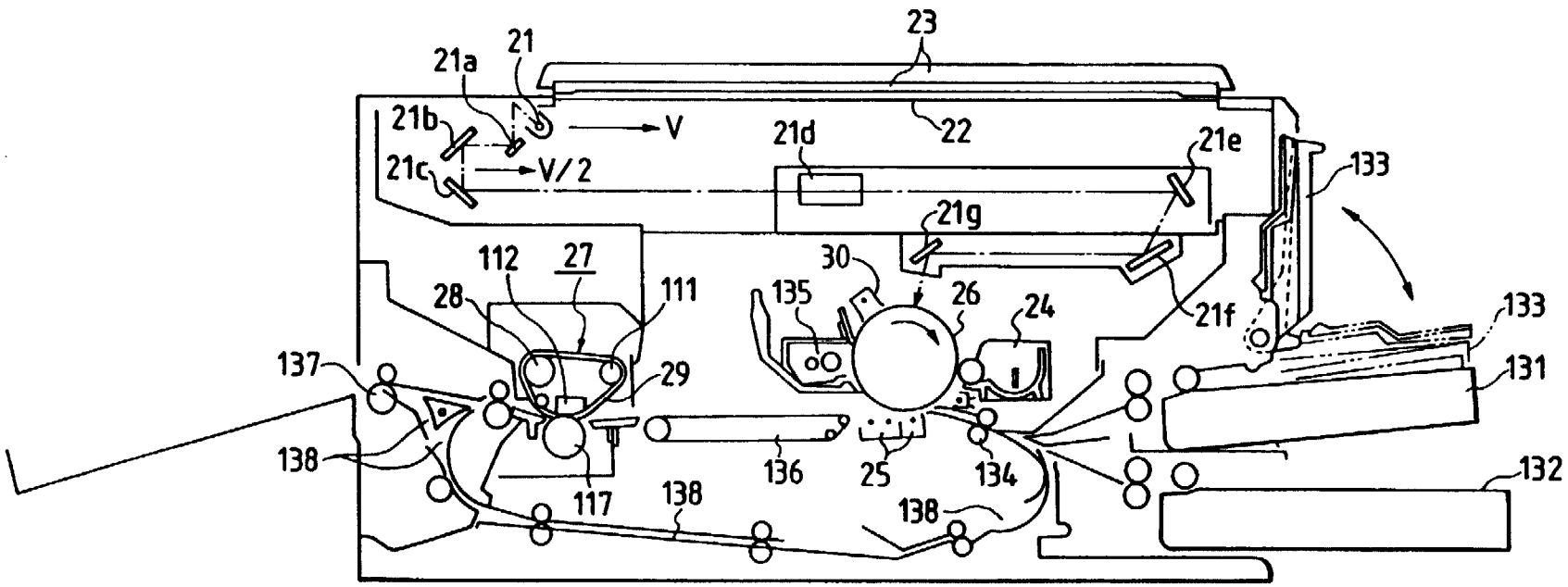
FIG. 8 is an elevational sectional view of the image forming system according to the third embodiment.

The image forming system shown in FIG. 8 as an elevational sectional view comprises an electrophotographic copying machine capable of performing the both-sided copy and multi-copy.

The original is set on an original support glass plate 22 so that an imaged surface of the original faces downwardly and an edge of the original is aligned with a predetermined reference, and then original is covered by an original cover 23.

In response to a copy start signal obtained by depressing a copy button, a rotatable drum-shaped photosensitive member 26 is rotated in a clockwise direction shown by the arrow at a predetermined peripheral speed (processing speed), and a peripheral surface of the photosensitive member 26 is uniformly charged with the predetermined charge by a charger 30. Further, a shiftable lighting lamp 21 and a first shiftable mirror **21*a* of an optical focusing system are shifted from left to right of the original support glass plate 22 at a constant speed V, and second and third shiftable mirrors 21*b*, 21*c* of the optical focusing system are shifted in the same direction at a constant speed of V/2, so that the downwardly facing image of the original is optically scanned from left to right. Light reflected from the scanned original image is focused on the peripheral surface of the photosensitive member 26 uniformly charged by the charger 30, via a focusing lens 21*d* and fourth to sixth fixed mirrors 21*e*, 21*f*, 21*g*, thus sequentially forming an electrostatic latent image corresponding to the original image on the peripheral surface of the photosensitive member 26**.

The latent image is then sequentially visualized with powdered toner (developer) consisting of resin and the like softened and melt with heat, by means of a developing device 24. The visualized toner image is transferred onto a surface of a transfer member (transfer sheet) as a recording sheet supplied one by one from a first sheet supply cassette 131 or second sheet supply cassette 132 or a manual sheet supply means 133 and fed into a transfer station between the photosensitive member 26 and a transfer charger 25 at a predetermined timing by means of a pair of resist rollers 134.

Figure 12:
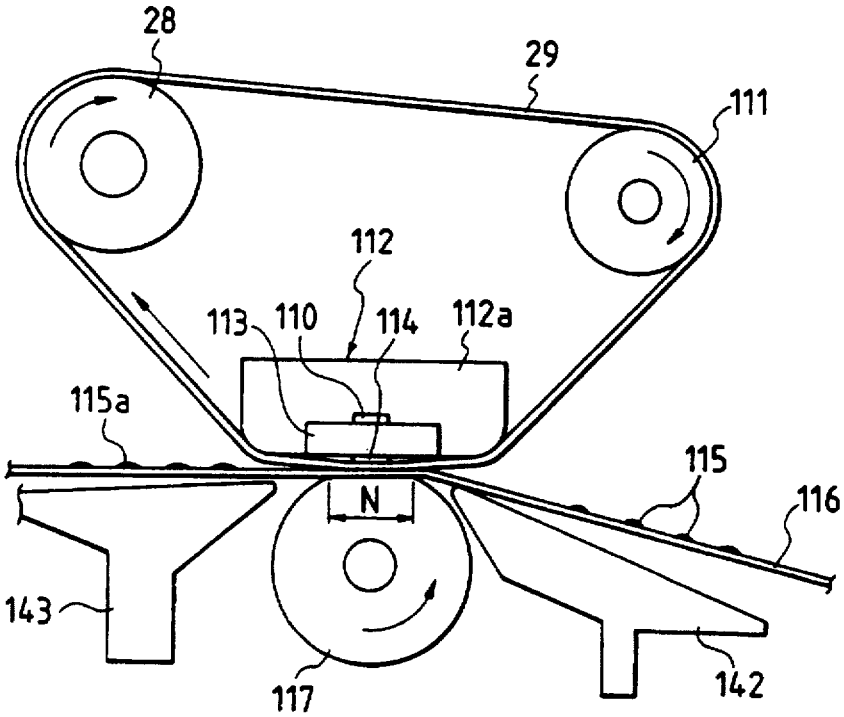
FIG. 12 is an enlarged sectional view of a fixing device.

The transfer sheet to which the toner image was transferred is sent, by a conveying device 136, to a fixing device 27, where the toner image is permanently fixed to the transfer sheet. Thereafter, the transfer sheet is ejected out of the copying machine by means of a pair of ejector rollers 137 as a printed matter or copy (in the case of a one-sided copying mode). Incidentally, the fixing device 27 comprises a drive roller 28, fixing film 29, driven roller 111, heating body 112 and pressure roller 117, as shown in FIGS. 8 and 12.

In case of a both-sided copying mode or multi-copy mode, the transfer sheet on which the image was formed or the transfer sheet having one surface on which the image was once fixed is introduced into a sheet re-feeding path mechanism 138 so that the sheet is re-supplied to the photosensitive member with or without turning the sheet over, respectively, thus performing the both-sided copying operation or the multi-copying operation, respectively. On the other hand, after the transferring operation, the photosensitive member 26 is cleaned by a cleaning device 135, thus preparing the next image formation.

At the same time when the copying operation finished in this way, the controller driver 42 of FIG. 7 is disconnected from the external AC power source 43, thereby returning the initial condition.

Figure 9:
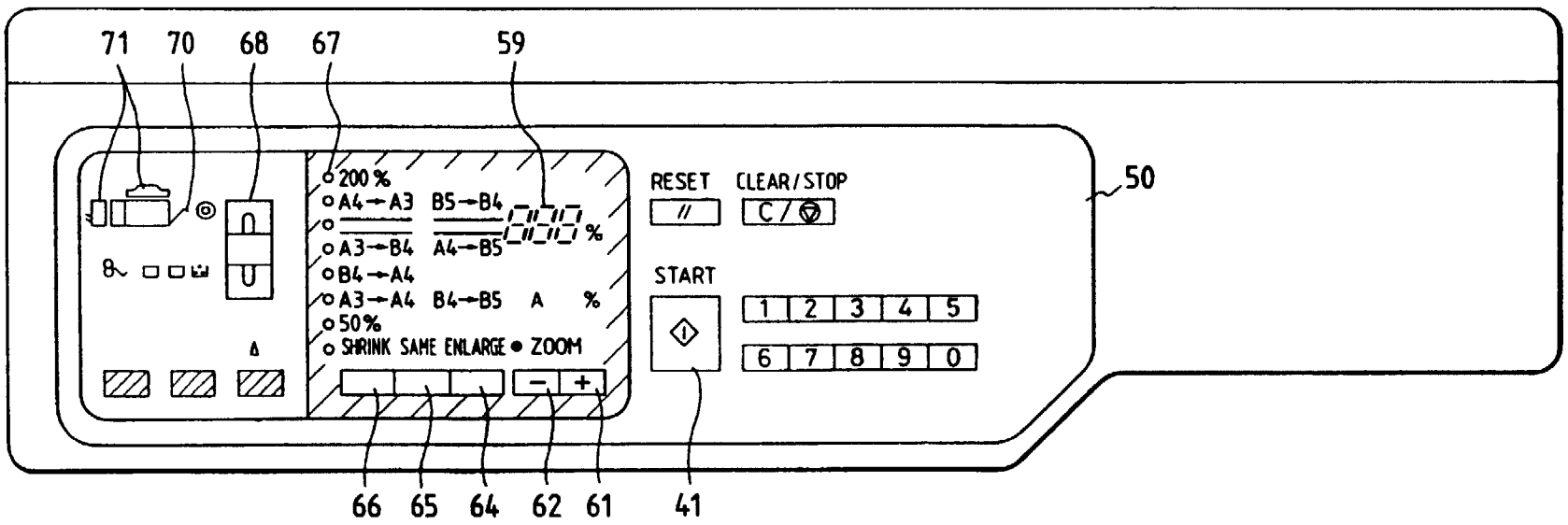
FIG. 9 is a plan view of an operation panel of the system of FIG. 8.

FIG. 9, an operation panel of the copying machine of FIG. 8.

In FIG. 9, an operation panel 50 includes the above-mentioned copy start switch 41 as shown in FIG. 7, and further includes an LED display portion 59 for displaying the copy number, "enlarge" and the like, switches 61–62 and 64–66 for "enlarge", "shrink", "same" and the like, an LED portion 67 for displaying an "enlarge" value, "shrink" value and the like, a switch 68 for setting the image density and LED portions 70, 71 for displaying the jam position. The operator can set the copy number, magnification and the like and ascertain the various displayed contents by using the operation panel 50.

In this embodiment, the operation panel 50 receives the power from the battery 44 of FIG. 7, so that the copy number, magnification and the like can be set before the copy start switch 41 is depressed, without the external AC power source 43. Thus, this embodiment is particularly effective to adapt to an image forming system having multi-function.

Figure 10:
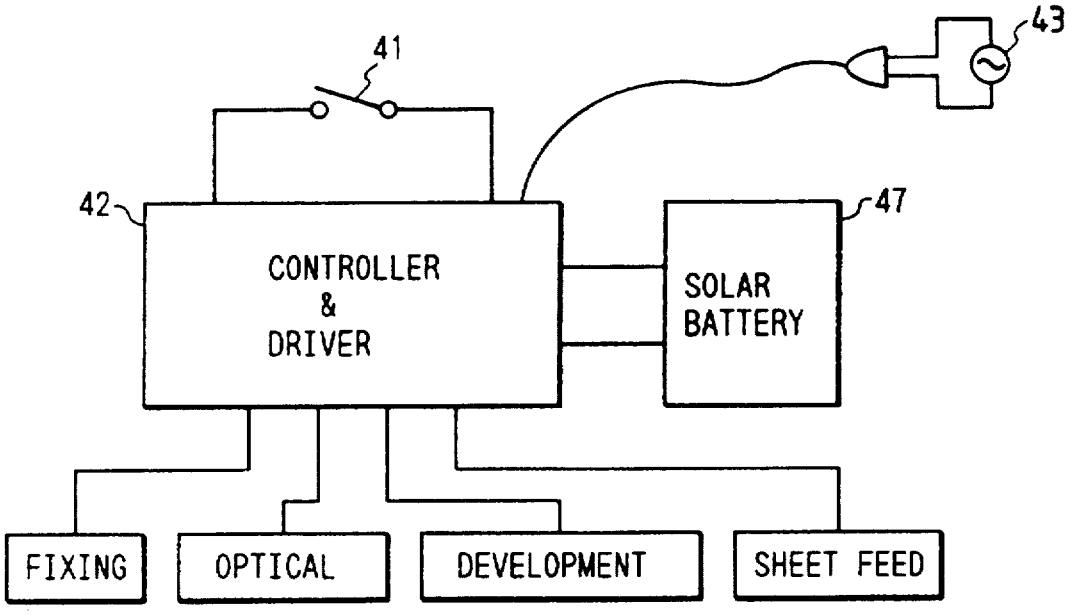
FIG. 10 is a block diagram of an image forming system according to a fourth embodiment of the present invention.

FIG. 10 shows a fourth embodiment of the present invention, wherein, in place of the battery 44 of FIG. 7, a solar battery 47 is used.

Figure 11:
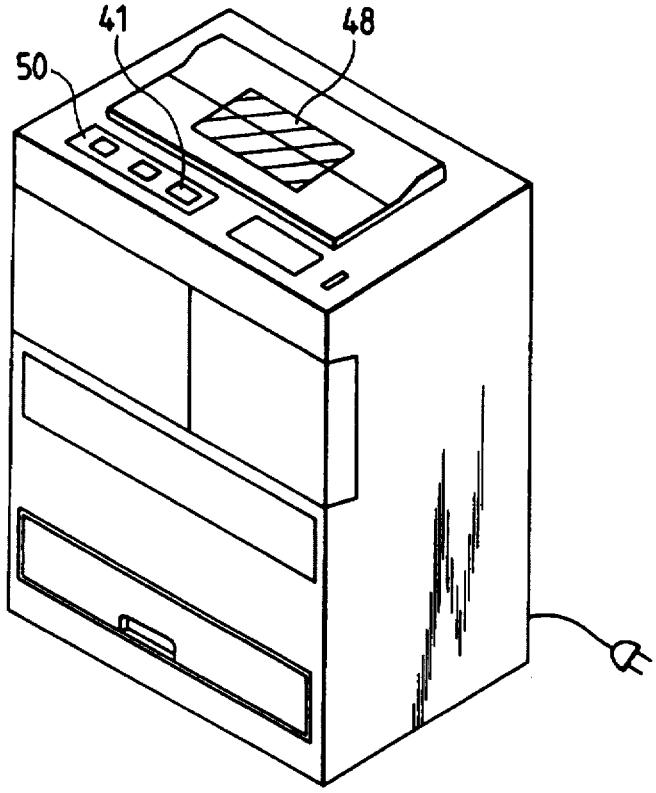
FIG. 11 is a perspective view of the image forming system according to the fourth embodiment.

FIG. 11 shows a light receiving portion 48 of the solar battery 47. The light receiving portion 48 is disposed on an original cover and a power from the solar battery is used as a copy start power source. Incidentally, the light receiving portion 48 of the solar battery 47 is not limited to be disposed on the original cover, but may be arranged at any location so long as it can receive the external light energy.

Next, a fifth embodiment of the present invention will be explained.

In this embodiment, since the construction of an image forming system may be the same as that of FIG. 8, the detailed explanation thereof will be omitted.

First of all, a fixing device will be fully described. FIG. 12 is an enlarged sectional elevational view of a fixing device 27 comprising a fixing film 29 of endless belt type which is supported by and extending around a left drive roller 28, right driven roller 111 and fixed wire heating body 112 having a low heat capacity and disposed below and between the rollers 28, 111.

The driven roller 111 also serves as a tension roller, and the fixing film 29 is driven in a clockwise direction at a predetermined peripheral speed without shrink, skew-feed and time lag, as the drive roller 28 is rotated in a clockwise direction.

A pressure roller 117 having an elastic rubber layer such as a silicone rubber layer having the good releasing ability is urged against a lower surface of the heating body 112 with a total pressure of, for example, 4–7 kg by an appropriate biasing means (not shown), with the interposition of a lower run of the endless fixing film 29. The pressure roller is rotated in an counter-clockwise direction (normal direction) same as a feeding direction of a transfer sheet 116.

Since the drivingly rotated endless fixing film 29 is repeatedly used to thermally fix the toner images, it should have the good heat-resistance, good releasing ability and good durability and generally have a thickness less than 100 μm and preferably less than 50 μm. For example, the fixing film may be constituted by a single film made of heat-resistive resin such as polyimide, polyetherimide, PES, PFA (tetrafluoroethylene-perfluoroalkyl vinyl ether copolymer resin) and the like, or a composite film comprising, for example, a base film having a thickness of 20 μm and a releasing coating layer having a thickness of 10 μm obtained by adding conductive material to fluoroplastics such as PTFE (tetrafluoroethylene resin), PAF and the like and adhered to at least a surface of the base film with which the image is contacted.

The wire heating body 112 having the low heat capacity comprises a heater support **112*a* having the rigidity, high heat-resistance and heat insulation along its longitudinal direction (perpendicular to a moving direction of the fixing film 29), and a heater board 113** integrally supported by a lower surface of the heater support and extending along the longitudinal direction of the latter.

The heater board 113 is made of heat-resistive and electrically insulative material, for example, such as an alumina plate having a thickness of 1.0 mm, a width of 10 mm and a length of 340 mm.

The heater board 113 is provided with an energization heat generating layer 114, and branch electric paths, energizing electrodes and temperature sensors (temperature detecting elements) 110 for limiting a heat generating (heating) area regarding the longitudinal direction of the energization heat generating layer 114 (heating body 112) to a predetermined extent, as will be described later.

As an example, the heat generating layer 114 comprises a line-shaped or strip-like low heat capacitive energization heat generating layer obtained by coating (for example, by the screen printing technique) the electrically resistive material such as $Ta_2N$, silver, silver palladium with a width of 1.0 mm on a substantially central portion of the lower surface (contacting with the film) of the heater board 113 along the longitudinal direction thereof.

The heater support **112*a* serves to ensure the required strength of the whole heating body 112**, and, for example, is made of high heat-resistive resin such as PPS (polyphenylene sulfide), PAI (polyamideimide), PI (polyimide), PEEK (polyether ether ketone), liquid crystal polymer or the like, or composite material combined with such resin and seramic, metal, glass and the like.

The temperature sensors 110 are disposed on a surface of the heater board 113 which is opposed to the surface on which the energization heat generating layer 114 is formed. In the illustrated embodiment, the temperature sensors 110 detect the temperature of the heater board 113 as the temperature of the heating body 112.

In this embodiment, the line-shaped or strip-like heat generating layer 114 is heated by supplying electric power to the layer from both longitudinal ends thereof. The electric power may be a pulse-shaped wave from a DC power source, and is provided from an energization control circuit for varying a width of each of pulses (drive pulses) corresponding to the desired temperature and energy emitting amount controlled by the temperature sensors 110 and a microcomputer.

Further, in the illustrated embodiment, a sensor (not shown) for detecting a leading end and a trailing end of the transfer sheet is arranged near and at an upstream side of the fixing device 27 in the sheet feeding direction so that the energizing time period for the heating body 112 is limited to a time duration during when the sheet 116 is being passed through the fixing device 27.

Next, the operation of the fixing device will be described.

After the image forming system started by the copy start signal has finished the image formation, when a leading end of the transfer sheet 116 on which a non-fixed toner image 115 is born and which is being sent to the fixing device 27 is detected by the above-mentioned sensor (not shown) disposed near the fixing device, the rotation (or running) of the fixing film 29 is started, with the result that the transfer sheet 116 is guided by a guide 142 to enter between the fixing film 29 and the pressure roller 117 (constituting a fixing nip N between the heating body 112 and the pressure roller 117). Thus, the non-fixed toner image is closely contacted with the undersurface of the moving fixing film 29 and is being passed through the fixing nip N between the heating body 112 and the pressure roller 117 with a predetermined pinching force together with the fixing film 29 overlapped thereto without discrepancy and shrink.

The heat generating layer 114 exists in an area corresponding to a width of a contacting area between the lower surface of the heating body 112 and the upper surface of the pressure roller 117, i.e., the fixing nip N. A toner image bearing surface of the sheet 116 is being passed through the fixing nip N while being closely contacted with the surface of the fixing film 29; meanwhile, the sheet is subjected to the heat from the heat generating layer 114 via the fixing film 29, with the result that the toner is softened and fused with high temperature to be fixed to the surface of the sheet 116 as an image area 115*a*.

In the illustrated embodiment, the separation between the sheet 116 and the fixing film 29 is effected immediately after the sheet 116 leaves the fixing nip N. At this separating point, since the temperature of the fused toner 115*a* is still higher than the glass transition point, the bonding force (adhesion force) between the sheet 116 and the fixing film 29 is small at the separating point. Thus, the sheet can always be separated from the fixing film 29 smoothly, without generating the toner offset from the sheet to the fixing film 29 and the poor separation (which causes the sheet jam because of the entrainment of the sheet 116 with the fixing film 29).

Further, since the fused toner 115*a* having the temperature higher than the glass transition point has the moderate elastic (rubber) feature, the toner image separated from the fixing film 29 becomes a moderate convex and a moderate concave shape, without simulating the surface of the fixing film 29. And, since the toner is cooled and solidified with such moderate convex and or concave shape, the fixed toner image has no excessive luster, thus providing the high image quality.

The sheet 116 separated from the fixing film 29 is sent to a pair of ejector rollers 137 while being guided by a guide 143; meanwhile, the temperature of the toner 115*a* is lowered, by the natural cooling, below the glass transition point to form the solidified toner image 115*b*. Then, the sheet 116 is ejected out of the copying machine.

Figure 13:
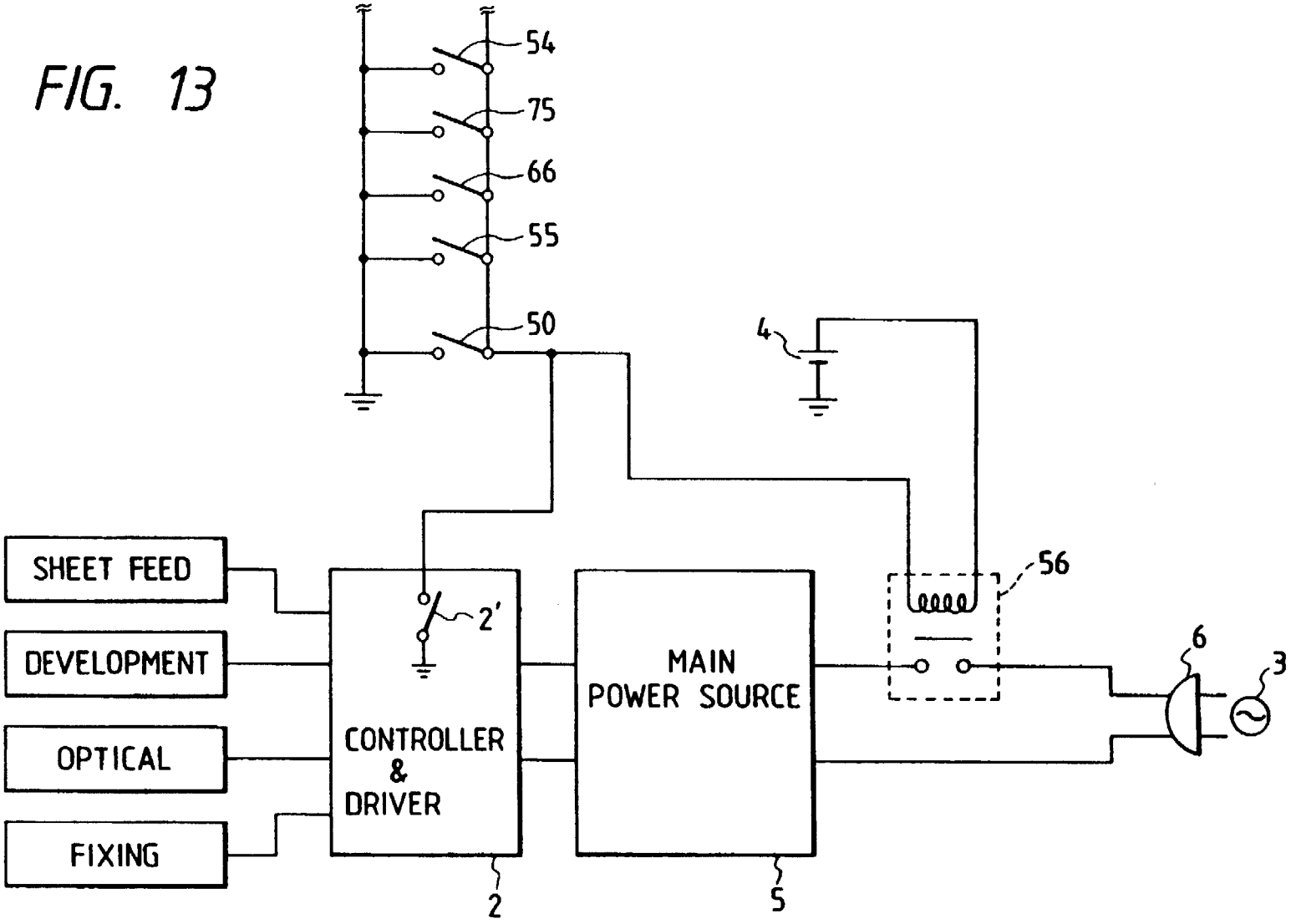
FIG. 13 is a schematic wiring circuit diagram of an image forming system according to a fifth embodiment of the present invention.
Figure 14:
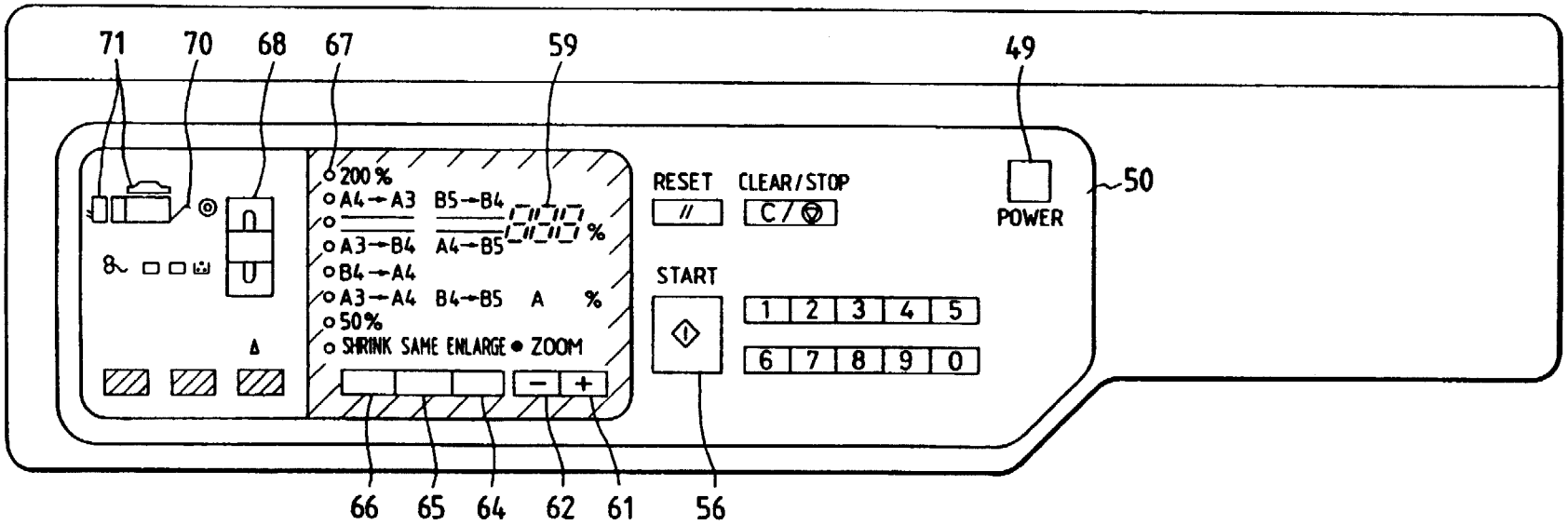
FIG. 14 is a plan view of an operation panel of the system according to the fifth embodiment.

FIG. 13 shows a wiring circuit, and FIG. 14 is a plan view of an operation panel. The following description will be given with respect to both FIGS. 13 and 14.

A power source switch shown in FIG. 14 is arranged on the operation panel 50 and comprises a momentary switch. When the operator turns ON this switch 49, a relay 56 connected to a battery 4 is turned ON so that the power from an external power source 3 is supplied to a power source 5 of main body via a power source line 6, thus activating a controller driver 2 connected to the power source 5 of main body. In this case, since a switch 2' arranged in the controller driver 2 keeps an ON condition, even when the switch 49 is turned OFF, the controller driver can receive the power from the external power source 3 intermittently. This operation is effected instantaneously to bring the copying machine to a stand-by condition. Then, the predetermined operations are performed in accordance with the copy sequence such as the sheet supply, development, fixing and the like.

In this embodiment, the power source switch 49 is not limited to the momentary switch or key switch, but may be a key switch provided on the main body. After the copying operation, the switch 2' in the controller driver 2 of FIG. 13 is automatically turned OFF to turn OFF the relay 56, thus disconnecting the power source 5 of main body from the external power source 3. Switch 54 selects the number of copies.

While the present invention was described with reference to the specific embodiments, the present invention is not limited to these embodiment, but various alterations can be effected without departing from the scope of the present invention.

What is claimed is:

1. An image forming apparatus, comprising:

recording sheet supplying portion for supplying a recording sheet;

recording sheet detecting means for detecting whether the recording sheet is present on said recording sheet supplying portion;

image forming means for forming a non-fixed image on the recording sheet supplied from said recording sheet supplying portion;

fixing means for thermally fixing the non-fixed image onto the recording sheet;

control means for controlling a temperature of said fixing means so that the temperature becomes a predetermined temperature;

a main power source for supplying electric power to said image forming means and said fixing means; and a sub power source for supplying electric power to said recording sheet detecting means, wherein said main power source is turned on only in the case the recording sheet detecting means detects the presence of the recording sheet in the recording sheet supplying portion such that the image formation can be performed without manual control of the main power source, and after said main power source is turned on in response to the detecting of the recording sheet in the recording sheet supplying portion, said control means causes the temperature of said fixing means to reach said predetermined temperature before the recording sheet arrives at said fixing means.

2. An image forming apparatus according to claim 1, wherein said recording sheet supply portion comprises a manual sheet supply portion for supplying the recording sheet manually.

3. An image forming apparatus according to claim 1, wherein said main power source is turned OFF after a predetermined time period is elapsed from a time when the recording sheet is detected to a time when a next recording sheet is detected.

4. An image forming apparatus according to claim 1, further comprising jam detecting means for detecting a jam of the recording sheet, and while said image forming apparatus is in the jam condition, the main power source is maintained in an ON condition in spite of a detection output of said recording sheet detecting means.

5. An image forming apparatus according to claim 4, further comprising display means for displaying the jam condition.

6. An image forming apparatus according to claim 1, wherein said fixing means fixes the image with pressure.

7. An image forming apparatus according to claim 1, wherein said fixing means includes a heating body maintained to the predetermined temperature and adapted to thermally fix the image on the recording sheet, wherein said heating body is energized after the recording sheet is detected by said recording sheet detecting means and the temperature of said heating body reaches the predetermined temperature before the recording sheet enters into said fixing means.

8. An image forming apparatus according to claim 7, wherein said fixing means comprises the heating body, the heating body having a resistive layer in which heat is generated by energizing the heating body which is used in a stationary condition, and a film slidingly contacting with said heating body, and wherein the image on the recording sheet is heated by heat from said resistive layer without the interposition of any air layer therebetween.

9. An image forming apparatus according to claim 1, wherein said main power source is turned OFF when the image formation is finished and when the fact that the recording sheet does not exist within said image forming apparatus is detected.

10. An image forming apparatus, comprising:

image forming means for forming a non-fixed image on a recording sheet;

fixing means for thermally fixing the non-fixed image onto the recording sheet, said fixing means having a fixing heater for generating heat when energized;

power supply control means for controlling a power supply to said fixing heater, said power supply control means causing power to be supplied to the fixing heater in response to reception of an image formation signal to cause the fixing heater to reach a predetermined temperature before the recording sheet arrives at the fixing means;

a main power source; and main power source switching means for automatically controlling said main power source, wherein said main power source is turned ON only in response to the reception of the image formation signal such that image formation can be performed without manual control of the main power source.

11. An image forming system according to claim 10, further comprising a print switch, wherein said image formation signal is generated when said print switch is depressed.

12. An image forming apparatus according to claim 10, further comprising an operation panel, and a sub power source for supplying electric power to said operation panel.

13. An image forming apparatus according to claim 12, wherein said sub power source comprises a battery.

14. An image forming apparatus according to claim 13, wherein said battery is a solar battery.

15. An apparatus according to claim 10, wherein said fixing heater is used in a stationary condition, and said fixing means further comprises a film slidingly contacting with said fixing heater, wherein the image on the recording sheet is heated by heat from said fixing heater without the interposition of any air layer therebetween.

* * * * *

UNITED STATES PATENT AND TRADEMARK OFFICE

CERTIFICATE OF CORRECTION

PATENT NO. : 5,546,161

DATED : August 13, 1996

INVENTORS : Akihiro Sakai, et al.

It is certified that error appears in the above-identified patent and that said Letters Patent is hereby corrected as shown below:

COLUMN 6

Line 10, "be" should read --be a--.

COLUMN 9

Line 55, "and" should be deleted.

COLUMN 12

Line 20, "system" should read --apparatus--.

Signed and Sealed this

Seventeenth Day of December, 1996

*Attest:*

*Attesting Officer*

BRUCE LEHMAN

*Commissioner of Patents and Trademarks*